United States Patent [19]

Cappel et al.

[11] 4,183,298

[45] Jan. 15, 1980

[54] WATER COOLED INK ROLLER FOR PRINTING PRESSES

[75] Inventors: Bert Cappel, Lammerspiel; Peter Mayer, Muhlheim; Burkhardt Wirz; Peter Decker, both of Munich, all of Fed. Rep. of Germany

[73] Assignees: Roland Offsetmaschinenfabrik Faber & Schleicher AG; Grapho Metronic Mess-und Regeltechnik GmbH & Co., both of Fed. Rep. of Germany

[21] Appl. No.: 878,735

[22] Filed: Feb. 17, 1978

Related U.S. Application Data

[63] Continuation-in-part of Ser. No. 863,734, Dec. 23, 1977, abandoned.

[51] Int. Cl.[2] ..... B41F 31/26; F28D 11/02; F28F 5/02; B21B 27/06

[52] U.S. Cl. ..... 101/348; 165/90; 34/124

[58] Field of Search ..... 101/348, 349, 416 A; 34/119, 124, 125; 165/89, 90, 91

[56] References Cited

U.S. PATENT DOCUMENTS

| | | | |
|---|---|---|---|
| 1,763,689 | 6/1930 | Drake | 165/90 |
| 1,837,562 | 12/1931 | Mayer | 34/124 |
| 2,875,985 | 3/1959 | Hold | 34/124 X |
| 2,972,298 | 2/1961 | De Marchi et al. | 101/350 X |
| 3,141,408 | 7/1964 | Bernardi et al. | 101/350 X |
| 3,237,685 | 3/1966 | Heisterkamp | 165/90 |
| 3,498,591 | 3/1970 | Calkins | 34/124 X |
| 3,838,734 | 10/1974 | Kilmartin | 165/190 |
| 4,090,553 | 5/1978 | Beghin | 165/89 X |

*Primary Examiner*—J. Reed Fisher

*Attorney, Agent, or Firm*—Leydig, Voit, Osann, Mayer & Holt, Ltd.

[57] ABSTRACT

An ink roller for a printing press having a cylindrical outer shell presenting a roller surface and having a control fluid-displacing core, a hollow cylindrical partition being interposed between the shell and the core to define inner and outer annular passageways connected in series having respective inlet and outlet openings. A source of cooling fluid is connected to the inlet opening so that a feed stream of cooling fluid flows longitudinally through the inner passage and turns around to form a cooling stream flowing in counterflow relation through the outer passage. The cylindrical partition is formed of conductive material so that heat absorbed at a given region of the roller surface by the cooling stream flows radially inwardly for absorption by the feed stream at substantially the same rate, so that the cooling stream has only minimum net gain or loss of heat; this tends to equalize the temperature along the length of the cooling stream and hence along the length of the roller surface. In the preferred embodiment of the invention the thermal conductivity of the cylindrical partition in the radial direction is so varied as a function of length that the rate of heat transfer radially through the partition from the cooling stream to the feed stream over each unit of length of the partition is substantially equal.

7 Claims, 10 Drawing Figures

WATER COOLED INK ROLLER FOR PRINTING PRESSES

This is a continuation-in-part of application Ser. No. 863,734 filed Dec. 23, 1977, now abandoned.

It is known to flow water at a controlled temperature through the rollers in an inking unit, in particular the distributor rollers, for the purpose of controlling the temperature of the ink and to minimize temperature change during momentary shut-down. To minimize change during shut-down it is desirable to maintain the water inlet temperature just below the ambient temperature. However, it is not practical to maintain the water temperature at just below ambient because of the lack of air conditioning in many press rooms and because of the wide variations in temperature occurring throughout the day. However, even where the temperature of the press room is relatively constant considerable variation in the temperature of the roller surface may occur along the length of the roller. For example, where cooling water is admitted at one end of the roller and discharged at the other end a temperature rise occurs progressively during the course of flow so that the roller at its inlet end is maintained at a lower temperature than at its outlet end.

It is, accordingly, an object of the present invention to provide a cooling arrangement for an ink roller which maintains ink temperature substantially constant even during machine stoppages. It is another object to provide an ink roller cooling arrangement in which the temperature of the roller surface, and hence the ink, is maintained substantially constant over the length of the roller both during conditions of normal running of the roller and during conditions of shut-down.

It is a related object to provide an ink roller cooling arrangement which is capable of counteracting wide and sudden swings in the temperature of the press room and which maintains the ink at a substantially constant temperature over short and long press runs and in the face of long or short periods of shut-down.

It is still another object of the present invention to provide an ink roller cooling arrangement which is simple and economical, which operates substantially automatically without care or attention on the part of a pressman, and which requires only a small mass of water within the roller and which permits variation in rate of flow.

Figure 1:
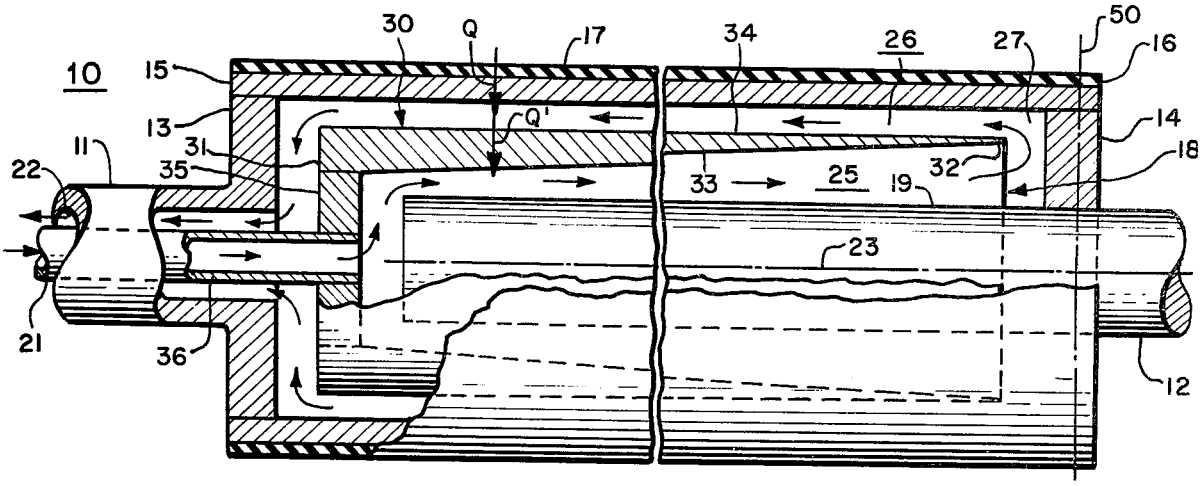

Other objects and advantages of the invention will become apparent upon reading the attached detailed description and upon reference to the drawings in which:

FIG. 1 shows a longitudinal section of an ink roller employing the present invention.

Figure 1A:
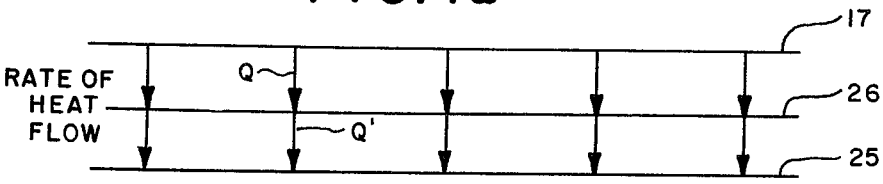

FIG. 1*a* shows the rate of heat flow at various points along the length of the roller.

Figure 1B:
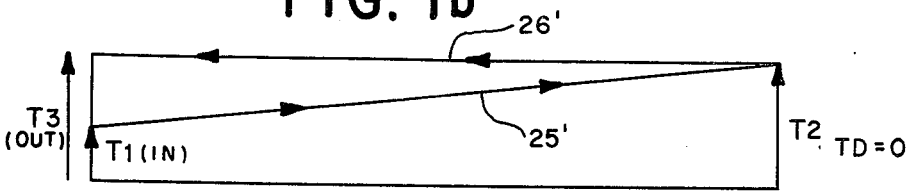

FIG. 1*b* shows the variation in temperature of the cooling fluid from inlet to outlet.

Figure 1C:
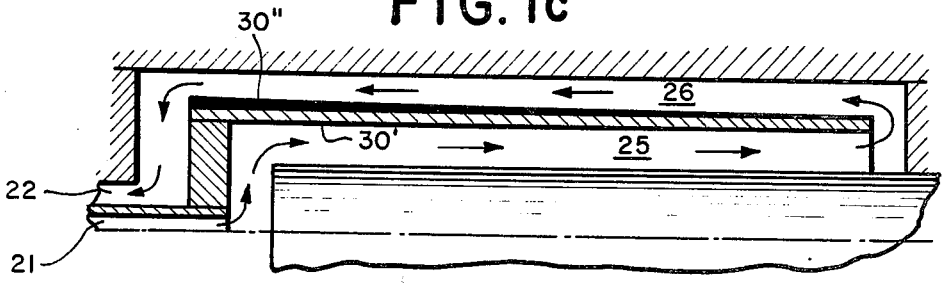

FIG. 1*c* is a fragment showing a cylindrical partition of composite construction.

Figure 2:
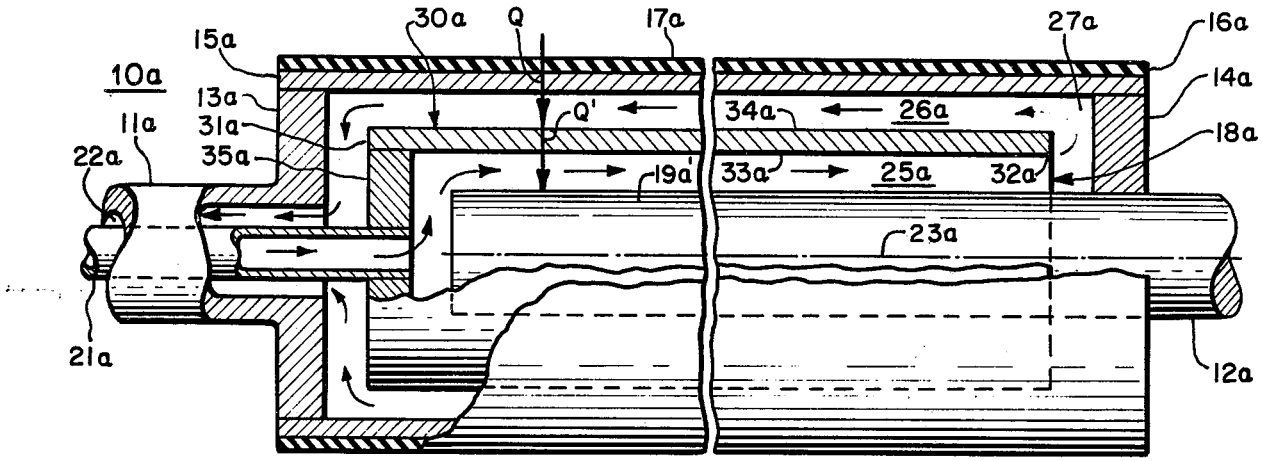

FIG. 2 is a view similar to FIG. 1 but showing a simplified form of the present invention including a partition having constant thermal transmission characteristics throughout its length.

Figure 2A:
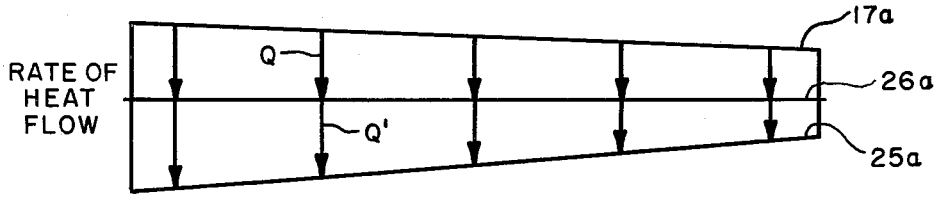
Figure 2B:
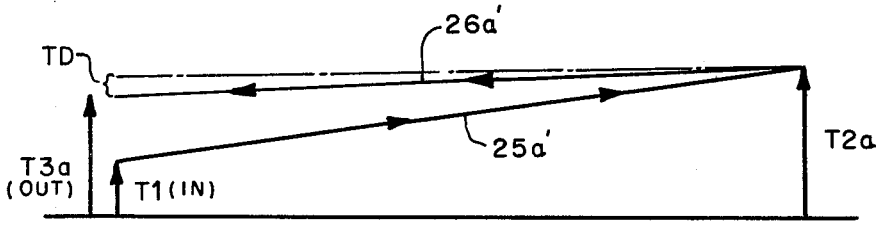

FIGS. 2*a* and 2*b* are heat flow and temperature diagrams corresponding to the construction of FIG. 2.

Figure 3:
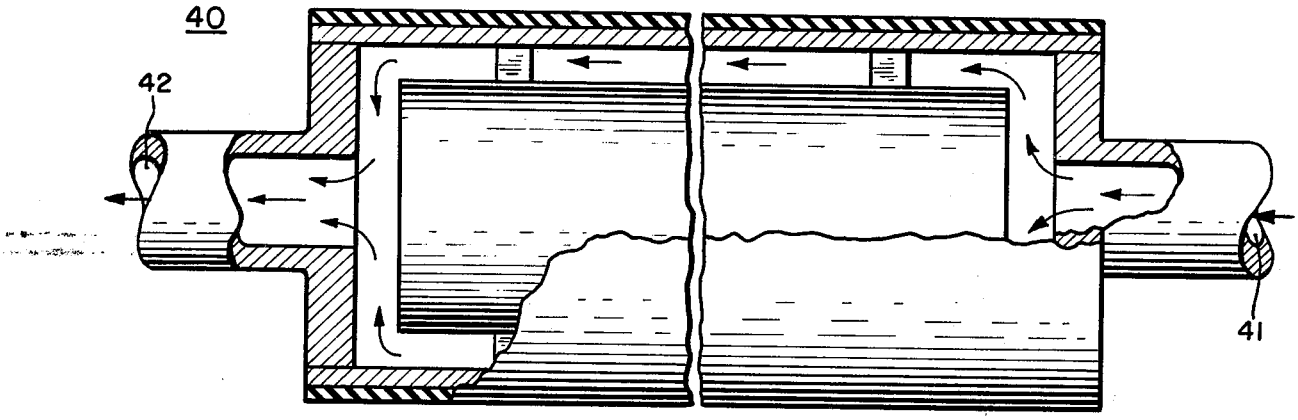
FIG. 3 (PRIOR ART)

FIG. 3 shows in longitudinal cross section, a prior art roller not including the counter flow principle.

Figure 3A:
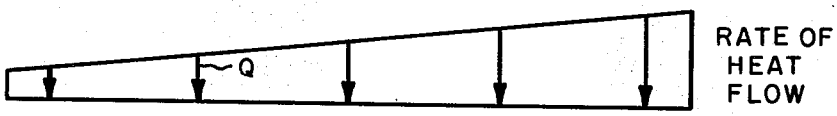
Figure 3B:
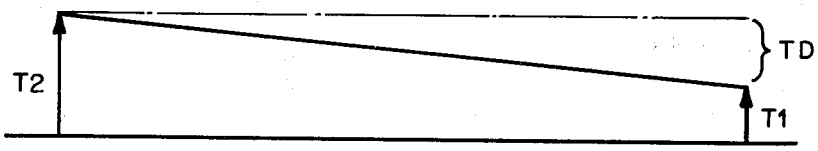

FIGS. 3*a* and 3*b* are heat rate and temperature diagrams corresponding to the construction of FIG. 3.

While the invention has been described in connection with certain preferred embodiments, it will be understood that we do not intend to be limited to the particular embodiments shown, but intend, on the contrary, to cover the various equivalent and alternative forms of the invention included within the spirit and scope of the appended claims.

Turning now to the drawings there is shown, in cross section, in FIG. 1 a roller 10 constructed in accordance with the invention. The roller has a shaft consisting of two portions 11, 12 mounting end plugs 13, 14 which carry a cylindrical outer shell 15. The shell has a rubber cover 16 which presents a resilient outer surface 17, the shell defining a hollow space 18.

Centered within the hollow space 18 is a cylindrical core 19 which acts as a displacement body, limiting the space 18 to the annular region adjacent the roller periphery, thereby reducing the amount of cooling fluid necessary to fill the roller.

Communicating with the space 18 is an inlet opening 21 and an outlet opening 22, the openings being concentric with the roller center line 23, the inlet opening being connected to a suitable source of cooling fluid, normally water, supplied at a temperature which is substantially less than the operating temperature of the roller surfaces and which is below ambient temperature.

In accordance with the present invention a hollow cylindrical partition is interposed between the shell 15 and the core 19 to define inner and outer annular passageways 25, 26, respectively, the inner passage 25 being connected to the inlet opening 21 for conducting a "feed" stream of cooling fluid and the outer passage 26 being connected to the outlet 22 to conduct a "cooling" stream of fluid adjacent the outer shell. The streams flow in opposite directions, as indicated, being interconnected by a "turn-around" passageway 27.

The cylindrical partition, indicated at 30, has a first end 31, a remote end 32, an inner surface 33, and an outer surface 34. The first end 31 is supported upon a bushing or collar 35 which communicates with a central conduit 36 leading to the inlet opening 21.

The cylindrical partition is made of conductive material and, in the preferred form of the invention, the thermal conductivity of the partition in the radial direction varies from a minimum adjacent the inlet and outlet openings to a maximum in the region of turn around remote from such openings. Thus in FIG. 1 it will be noted that the partition is of tapering thickness, the thick left-hand portion indicating low conductivity and the thin right-hand portion denoting high conductivity. The conductivity is so varied that the rate of heat transfer radially through the partition from the cooling stream 26 to the feed stream 25 over each unit length of the partition is substantially equal notwithstanding the variation in temperature which occurs along the length of the feed stream, so that the temperature of the cooling stream and hence the temperature of the roller surface is maintained substantially equal over the length of the roller.

FIG. 1*a* is a diagram showing this desirable condition of heat rate which distinguishes the present invention. In this diagram the upper vectors Q denote the rate of heat flow over the length of the roller. Specifically the upper vectors Q show that equal heat is conducted inwardly from the roller surface into the space occupied by the cooling stream 26, the vectors at each point along the roller length being substantially equal. The lower vectors Q' show that under the conditions of the invention the rate of heat flow radially through the partition from the cooling passage 26 to the feed passage 25 at each unit length of the partition is also equal. In short, in practicing the invention in its preferred form, there is no net addition or subtraction of heat from the cooling stream 26 at any point along its length so that the cooling stream performs its cooling function at constant temperature.

Such constancy of temperature is shown in FIG. 1*b* where the incoming cooling fluid will be assumed to have a relatively low temperature T1. Because of the absorption of heat through the cylindrical partition 30 from the cooling stream 26, the temperature of the feed stream gradually rises along a path 25' reaching a temperature T2 at the region of turn-around. The temperature of the cooling stream during its counter flow, and as indicated at 26', is constant so that the cooling fluid is discharged at a temperature T3 which is equal to temperature T2. As stated, the reason for the constancy of the temperature of the cooling stream is that, as such stream flows from right to left, heat is lost to the partition 30 at the same rate that it is gained from the roller surface. Since there is neither a net loss or net gain of heat, the temperature, along the path of flow, remains substantially constant.

It is helpful, in understanding the invention, to consider the following: cooling fluid enters at a relatively low temperature T1 but since it loses heat to the partition as it flows, the temperature gradually rises to a level T2 at the point of turn-around. Assuming it is desirable to maintain the temperature of the cooling stream constant along its length, since the entering heat is also constant along the length of the roller, it is necessary that heat shall flow radially outwardly from the feed stream at an equal rate at any point along the length of the stream. This condition can only be met by increasing the conductivity of the partition in the radial direction in accordance with the increase in temperature. To employ an electrical analogy, as the voltage (temperature) difference between the streams progressively decreases the conductivity of the radial heat path between the streams must increase in order to keep the current (heat rate) constant between the two streams.

The result, in any event, is to produce a temperature difference of zero from one end of the cooling stream 26 and the other. With the temperature of the cooling water constant along the length of the stream 26, the surface of the roller will also tend to remain constant along its length.

This is to be contrasted with a prior art water cooled ink roller illustrated at 40 in FIG. 3 in which the cooling water enters at an inlet opening 41 at a temperature T1 and discharges, at the opposite end of the roller, at an outlet opening 42 at a higher temperature T2. This results in a temperature difference TD along the length of the roller which is substantial and which causes the heat to be absorbed from the surface of the roller at a rate Q which varies substantially along the roller length.

It is found that the present roller cooling arrangement not only tends to maintain the temperature of the ink constant during periods of shut down, but the ink is maintained at a safely low and relatively constant temperature over the entire roller surface and during long and short runs and substantially independently of swings in ambient temperature. Moreover, it is found that once the system is engineered and installed it requires little or no care or attention on the part of the operator, with the constant temperature operating characteristics being maintained over a relatively wide range of water input temperature and rate of flow.

In the embodiment of the invention discussed above the conductive partition 30 is shown (FIG. 1) to be tapered in thickness with the thickness at each point being inversely related to conductivity. However, if desired the conductive partition may be formed of a layer of metal of constant thickness as indicated at 30' in FIG. 1*c*, with a superimposed layer 30'' of insulating material which is applied in the form of a coat which increases in thickness along the direction of flow of the cooling stream. The insulating layer 30'' may be formed of any material which resists erosion due to water flow and which has a conductivity which is substantially less than that of the usual thermally conductive metals.

While the invention has been described above in connection with a hollow cylindrical partition having progressive radial conductivity from point to point along its length, it is found that the invention may be practiced using a cylindrical partition having a constant conductivity in the radial direction employing the counter flow feature while still achieving the major advantages of the invention. It will be apparent upon considering FIG. 2 in which parts corresponding to FIG. 1 are indicated by the same reference numerals with addition of subscript a. In the embodiment of FIG. 2 the partition 30*a* is in the form of a sleeve of aluminum copper or the like and of constant thickness. This relatively increases the thermal coupling between the feed stream 25 and cooling stream 26 in the region adjacent the inlet and outlet openings as indicated by the increased size of the heat rate vectors in this region. Conversely the heat rate at the remote region of the partition is correspondingly reduced as indicated by the heat vectors at the right-hand side of FIG. 2*a*.

Assuming cooling fluid to enter at temperature T1 the temperature, as in the earlier embodiment, rises progressively, reaching a value T2*a* at the point of turn-around. The temperature T2*a*, because of the increased thermal coupling and increased absorption of heat by the feed stream 25, slightly exceeds the temperature T2 in the earlier embodiment. The temperature in the cooling stream 26*a* remains relatively constant as indicated at 26*a'* dropping slightly to a value T3*a* at the output and resulting in a temperature difference TD over the length of the cooling stream, which is small enough to be tolerable. FIG. 2*b* shows the variation in temperature using a partition of rather highly conductive material which results in some degree of localized short circuiting of heat between the fluid at the inlet and outlet openings. To reduce the short circuiting effect the partition 30*a* may be reduced in conductivity over all, for example, by applying an insulating coat to the outer or inner surfaces. The embodiment of FIG. 2 has the advantage that it can be manufactured more cheaply than the embodiment of FIG. 1 while still providing acceptable thermal characteristics.

In both of the embodiments it has been assumed that the cooling fluid enters the inlet, travels the length of the roller, and counter flows over the entire length to the outlet. In practicing the invention it is not necessary for there to be a single inlet and outlet. Particularly in the case of exceptionally long rollers the structure may be duplicated, as a mirror image, about the vertical line 50 in FIG. 1 so that each cooling system occupies one-half of the total roller length.

The present invention is not limited to use in a resilient ink roller and it will be apparent to one skilled in the art that the counter flow feature, either with or without the variable conductivity feature will find equal application in other rotating elements of a printing press, primarily ink drums, heat exchange rollers and the like.

It will be understood that the supplementary figures are solely for the purpose of conveying an understanding of the invention and that values or dimensions shown therein are approximate and not quantitative. Similarly it will be understood that the proportions of the roller itself will, in a practical case, differ from the drawing, characteristically having a longer form factor as indicated by the break line in FIG. 1.

One skilled in the art will appreciate that while the partition 30 has been shown to be smoothly cylindrical, the partition may be provided with longitudinally extended fins, either along its outer surface or along its inner surface, the fins increasing in radial extent to provide proportionally increased conductivity as the region of turn-around 27 is approached.

It is one of the features of the present construction that operation is largely automatic, requiring little care or attention on the part of the pressman. Since equal quantities of water flow in the feed passageway 25 and the cooling passageway 26, variations in flow are largely self-compensating. The minimum rate of flow should preferably be such as to produce turbulence along the entire flow path, but this is not essential to the invention.

While the invention has been discussed above without reference to the thermal function performed by the resilient roller cover 16, it is found that in addition to providing a necessary resilience it performs a thermal insulative function which cooperates with the function of the partition 30 to produce improved overall result. While the illustrated temperature variations in heat rates are characteristic of steady state conditions, it will be understood that the ambient temperature in a press room, the cooling water, and printing conditions are all subject to transient change. The resilient layer 16, because of its thermally insulative effect, causes the transient change to be felt gradually. For example, a sudden increase in external temperature, instead of imposing a sudden load upon the cooling stream 26, is felt only gradually giving time for the added heat to be transmitted to the inner feed stream 25, notwithstanding the inherent delay in passage of heat through the partition. In short, the thermal insulation provided by the rubber layer tends to counteract any thermal delay inherent in the partition, thereby preventing the system from overreacting to the transient change. In short, the system in spite of transient changes tends to operate constantly in a state of near equilibrium. This is equally true in the case of an external temperature drop. The system for analogous reasons is equally immune to transient changes in cooling water temperature; that is, a transient change in cooling water temperature, because of the thermal delay in the rubber covering, has substantially no effect upon the ink.

While the source of cooling water, as stated above, is not critical in the practice of the present invention, it will be understood by one skilled in the art that the source may have conventional means for thermostatic control to provide a relatively constant source temperature thereby to achieve the ultimate benefit provided by the present roller design. And although the emphasis has been on the cooling function, a drop in ambient temperature below the level of the cooling fluid will reverse the direction of heat flow so that the terms "cooling fluid" or "cooling water" shall be considered generic to heat flow in either direction.

What we claim is:

1. An ink roller for a printing press comprising, in combination, a shaft, a cylindrical outer shell secured to the shaft and presenting an outer roller surface, a central fluid-displacing core, a hollow cylindrical partition interposed between the shell and the core defining concentric inner and outer annular passageways connected in series with one another, means defining an inlet opening in the shaft connected to one end of the inner passageway, means defining an outlet opening in the shaft connected to the corresponding end of the outer passageway, a source of cooling fluid connected to the inlet opening so that a feed stream of cooling fluid moves longitudinally through the inner passageway and turns around to form a cooling stream flowing in counterflow relation through the outer passageway, the cylindrical partition being formed of conductive material so that heat absorbed from a given region of the roller surface by the cooling stream flows radially inward through the partition for absorption by the feed stream thereby to tend to equalize the temperature along the length of the cooling stream and hence along the length of the outer roller surface.

2. The combination as claimed in claim 1 in which the thermal conductivity of the cylindrical partition in the radial direction varies from a minimum adjacent the openings to a maximum at the region of turn-around of the fluid.

3. The combination as claimed in claim 2 in which the thermal conductivity of the cylindrical partition varies from a minimum adjacent the inlet and outlet openings to a maximum in the region of turn-around remote from such openings so that the rate of heat transfer radially through the partition from the cooling stream to the feed stream over each unit length of the partition is substantially equal and so that the temperature of the cooling stream and hence the temperature of the roller surface is maintained substantially equal along the length thereof, the partition tapering substantially the full length of the space within the cylinder.

4. The combination as claimed in claim 1 in which the cylindrical partition consists of a cylinder of metal having a greater radial thickness in the region of the openings and tapering to a thin section in the region of turn-around of the fluid.

5. The combination as claimed in claim 1 in which the inlet and outlet openings in the shaft are concentric with one another.

6. The combination as claimed in claim 1 in which the structure is repeated in mirror image over each half of the roller length.

7. In an ink roller for a printing press having a shaft and a cylindrical metal shell secured to the shaft and presenting an outer surface, a cooling system comprising a central fluid-displacing core, a hollow cylindrical partition interposed between the shell and the core defining concentric inner and outer annular passageways connected in series with one another, means defining an inlet opening in the shaft connected to one end of the inner passageway, means defining an outlet opening in the shaft connected to the corresponding end of the outer passageway, a source of cooling fluid connected to the inlet opening so that a feed stream of cooling fluid moves longitudinally through the inner passageway and turns around to form a cooling stream flowing in counterflow relation through the outer passageway, the cylindrical partition being formed of thermally conductive material so that heat absorbed from a given region of the outer surface by the cooling stream flows radially inward through the partition for absorption by the feed stream thereby to tend to equalize the temperature along the length of the cooling stream and hence along the length of the outer surface, the roller having a thermally insulative resilient layer covering its outer surface and which serves to insulate the system against the effects of transient temperature changes by interposing a thermal delay which tends to counteract any thermal delay inherent in the partition thereby preventing the system from over-reacting to a transient change.

* * * * *

UNITED STATES PATENT OFFICE

CERTIFICATE OF CORRECTION

Patent No. 4,183,298 Dated January 15, 1980

Inventor(s) Bert Cappel, Peter Mayer, Burkhardt Wirz and Peter Decker

It is certified that error appears in the above-identified patent and that said Letters Patent are hereby corrected as shown below:

On the title page:

After data item "[63]", insert the following item:

--Foreign Application Priority Data

December 23, 1976 Germany . . . . P 26 58 380 --

Signed and Sealed this

*Twenty-second* Day of *April 1980*

[SEAL]

*Attest:*

SIDNEY A. DIAMOND

*Attesting Officer* *Commissioner of Patents and Trademarks*